US005789849A

United States Patent [19]

Porembski et al.

[11] Patent Number: 5,789,849

[45] Date of Patent: Aug. 4, 1998

[54] LOW-PRESSURE DISCHARGE LAMP WITH BASE AND MOUNT

[75] Inventors: Horst Porembski, Munich; Andreas Hollstein, Ingolstadt, both of Germany

[73] Assignee: Patent-Treuhand-Gesellschaft fur elektrische Gluehlampen mbH, Munich, Germany

[21] Appl. No.: 783,251

[22] Filed: Jan. 14, 1997

[30] Foreign Application Priority Data

Jan. 15, 1996 [DE] Germany ..... 296 00 594 U

[51] Int. Cl.[6] ..... H01J 5/56

[52] U.S. Cl. ..... 313/318.02; 313/318.09; 439/612; 439/229; 362/216

[58] Field of Search ..... 313/51, 318.02, 313/318.09, 318.06; 439/612, 229; 362/216

[56] References Cited

U.S. PATENT DOCUMENTS

| | | | |
|---|---|---|---|
| 2,339,166 | 1/1944 | Harrison . | |
| 2,366,252 | 1/1945 | Geiger . | |
| 2,367,984 | 1/1945 | Webster et al. . | |
| 2,392,785 | 1/1946 | Thomas . | |
| 2,413,662 | 12/1946 | Thomas . | |
| 2,453,986 | 11/1948 | Greiner et al. . | |
| 2,480,301 | 8/1949 | Moretz | 362/216 |
| 2,733,417 | 1/1956 | Hinman et al. | 339/50 |
| 3,292,097 | 12/1966 | Gaynor | 339/50 |
| 3,752,977 | 8/1973 | Davis | 362/216 |
| 3,795,887 | 3/1974 | Higuchi | 339/50 C |
| 3,898,495 | 8/1975 | Livera | 313/51 |
| 4,002,394 | 1/1977 | Cordiano et al. | 339/50 C |
| 4,350,400 | 9/1982 | Gaynor | 439/229 |
| 4,468,071 | 8/1984 | Bradley et al. | 339/50 C |
| 4,569,004 | 2/1986 | Peterson | 362/216 |
| 4,643,504 | 2/1987 | Kuiper | 339/51 |
| 4,771,370 | 9/1988 | Lowe, Jr. et al. | 362/216 |

*Primary Examiner*—Sandra L. O'Shea
*Assistant Examiner*—Michael Day
*Attorney, Agent, or Firm*—Carlo S. Bessone

[57] ABSTRACT

A fluorescent lamp, particularly of annular shape, with a tube-shaped discharge vessel has a base with contact pins, in which the two ends of the vessel face each other. The contact pins are essentially arranged in the annular plane of the lamp on both sides of the base. The mount belonging thereto has a U-shaped profile. The arms of the mount are provided with recesses for taking up and making contact with the contact pins of the base. This makes possible a linear motion when inserting the base into the mount. Retaining springs on the mount and recesses on the base belonging thereto make possible a locking of the base with the mount. Another advantage is the small structural height of the lamp including the mount.

9 Claims, 3 Drawing Sheets

LOW-PRESSURE DISCHARGE LAMP WITH BASE AND MOUNT

FIELD OF THE INVENTION

This invention relates to a low-pressure discharge lamp with a base on one side with a tube-shaped discharge vessel, and a mount (socket) belonging thereto.

BACKGROUND OF THE INVENTION

Such lamps are characterized by their rather flat configuration. A tube-shaped discharge vessel typically with circular cross section is arranged for this purpose in one plane, such that the two ends of the discharge vessel face one another. The annular shape is particularly common. On the basis of the circular-symmetric irradiation characteristic associated therewith, these lamps are particularly suitable for all-purpose lighting, e.g., in residential and office rooms. For this purpose, the lamp bulb is generally incorporated in a lighting unit, which may also contain, if needed, an optical reflector for deflecting the light.

The current leads of the electrodes arranged inside the vessel are led to the outside in a gas-tight manner through the ends of the discharge vessel. The two ends of the vessel, including current leads, are surrounded by a common elongated base. The current leads are joined with electrical contacts of the base. The base contacts serve for making contact with the corresponding contacts of a lamp mount.

An annular fluorescent lamp (e.g., Osram L32/41-827C with base G10q), is known, in which the pin-shaped base contacts are arranged in a square configuration at an angle of 45° relative to the annular plane of the lamp.

It is a disadvantage in this solution, since it is time-consuming, that a relatively complicated course of movements for joining the base and the mount is necessary for mounting the lamp. Another disadvantage is the relatively voluminous base, which counteracts efforts in the direction of producing compact, particularly flat lighting devices.

SUMMARY OF THE INVENTION

The object of the invention is to eliminate the named disadvantages and to provide a low-pressure discharge lamp with a base on one side of the type explained initially, which has a compact, flat, as well as simply designed base, which makes possible a simple and rapid lamp mounting, and, if necessary, the assembly of a lighting unit.

Another object of the invention is to provide for a mount belonging to the base of the invention.

These objects are accomplished in one aspect of the invention by arranging the base contacts essentially in the plane in which the discharge vessel is extended, whereby one half of the base contacts are arranged on a first side of the base and the other half are arranged on the side of the base lying opposite the first. Preferably, the two base contacts of each end of the lamp are arranged on the sides of the base that lie opposite one another. In this way, the current leads can be held briefly for joining with the base contacts. Also, this can prevent the current leads from coming into contact in the base.

The base of the invention is characterized by a particularly small structural height. This base is particularly advantageously used with discharge tubes with particularly small diameters (typically 16 mm instead of the previously common 30 mm). This has the advantage that the entire arrangement of the lamp with base is relatively flat.

The mount belonging thereto has a groove-shaped opening for taking up the base. The two side walls of the opening are each provided with two slot-type recesses for taking up the base contacts. The contacts are arranged in the recesses. When the base is inserted into the mount, the contacts belonging thereto contact each other and thus secure the making of the contact between the base and the mount. The advantage of this solution is that only a single linear motion is required for assembling the lighting unit. Also, the mount contacts that usually lie at an increased electrical potential relative to their surroundings are protected in the recesses from accidental contact.

In one concrete configuration, the base of the invention has an elongated, cylinder-type basic form open at the two front sides. The circular-shaped openings of the base serve for taking up the two ends of the discharge vessel, including the current leads belonging thereto. Two pin-shaped contacts project from two opposite sides of the central square-shaped part of the base. The contacts are arranged in the plane in which the discharge vessel extends. Every two contacts—one contact from each of the two opposite sides—form a contact pair, which is joined with the two current leads per vessel end. Preferably the current leads are guided to the outside from the discharge vessel in the common plane of the base contacts. In this way, a particularly flat structural form can be produced in such a way that the current leads are unable to contact one another.

The mount belonging thereto has a basic U-shaped configuration. Each of the two arms of the mount has two slot-type recesses containing contacts. These serve for taking up and making contact with the respective base contacts. The lamp base is inserted into the space between the arms for this purpose.

In a first simple embodiment, the mount contacts are shaped like catch springs. When the base is inserted into the mount, the base contacts engage in the mount contacts. In this case, the mount contacts not only serve for making electrical contact, but also for locking the base, and consequently the lamp joined with the base, in the mount.

In a particularly preferred embodiment, the locking is undertaken by an additional fastening element. For this purpose, the two side walls of the groove-type opening are each provided with a nose-type retaining spring, which engages in corresponding recesses in the outer wall of the base when the base and mount are joined. This separation of contact function and holding function has the advantage that the contacts are not subjected to mechanical stresses. Consequently, a reliable con tact function is assured over long time periods and even after several changes of lamp bulb.

BRIEF DESCRIPTION OF THE DRAWINGS

The invention will become more readily apparent from the following exemplary description in connection with the accompanying drawings, wherein.

BEST MODE FOR CARRYING OUT THE INVENTION

Figure 1:
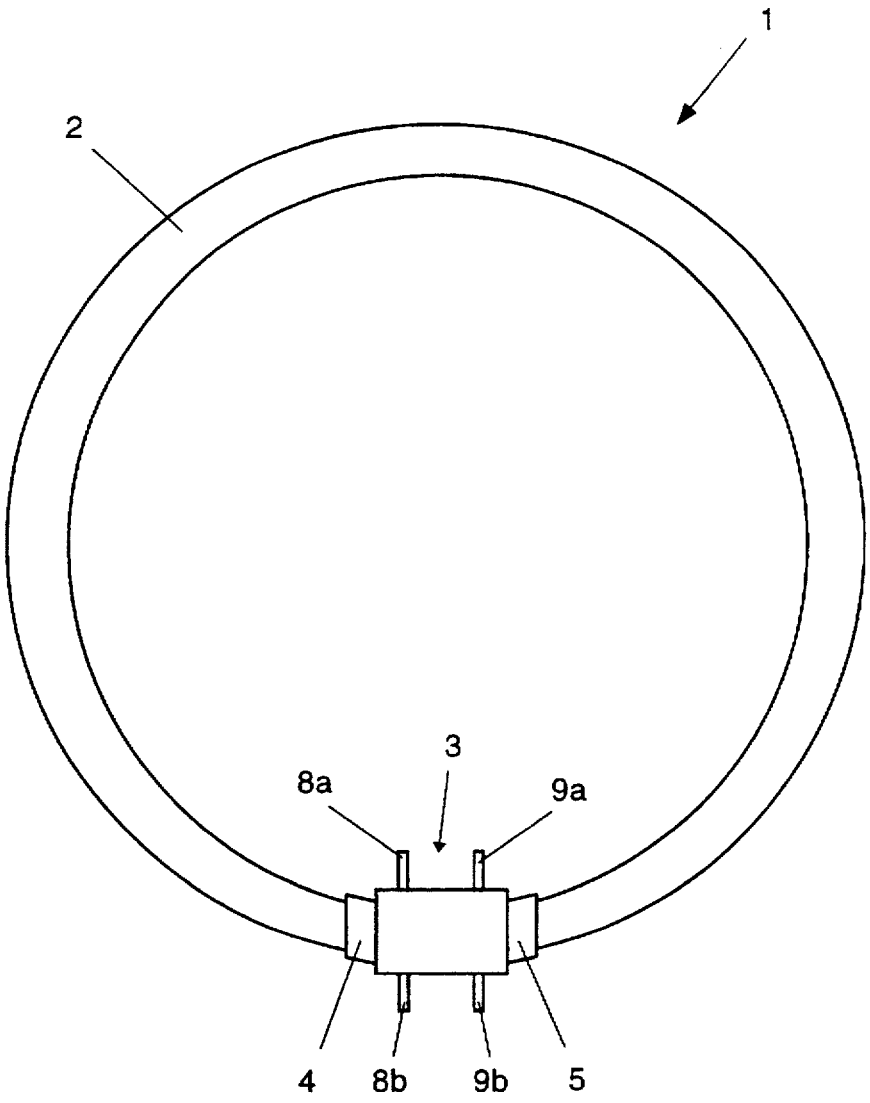
FIG. 1 shows the top view of an annular-shaped fluorescent lamp with a base on one side, according to the invention.

In FIG. 1, the top view of a fluorescent lamp 1 according to the invention is shown schematically. Fluorescent lamp 1 comprises an annular discharge tube 2 coated with a fluorescent substance, in a known way, in which two thermionic electrodes are arranged (not shown) and a base 3 with four pin-shaped contacts (8*a*, 8*b*, 9*a*, 9*b*), into whose circular-cylindrical-like extensions 4, 5, the two ends of discharge tube 2 project. Discharge tube 2 has a circular-shaped cross section with a diameter of approximately 16 mm. The base represents the actual novelty of the lamp and is thus explained in more detail in the following. The same reference numbers indicate the same features.

Figure 2A:
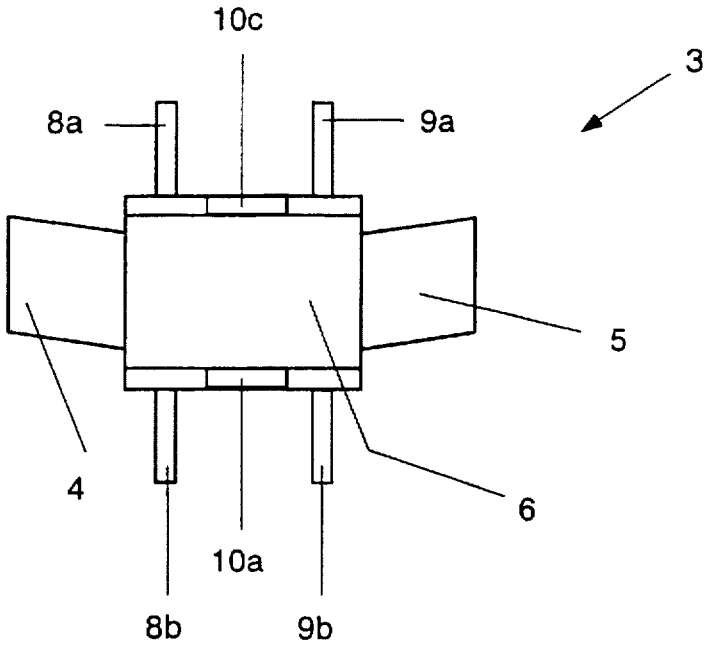
FIG. 2*a* shows the top view of the base of the fluorescent lamp of FIG. 1.
Figure 2B:
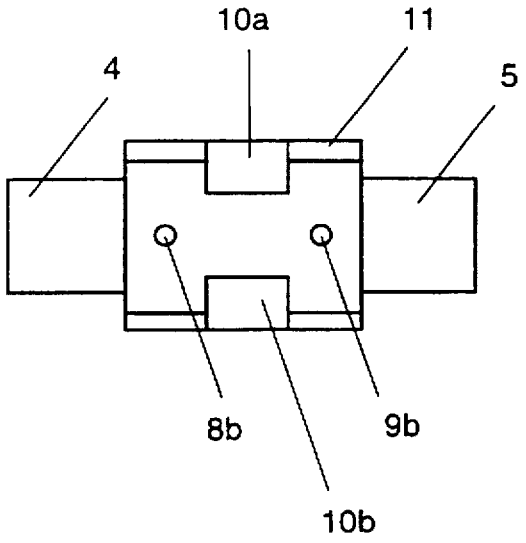
FIG. 2*b* shows the side view of the base of FIG. 2*a;*
Figure 2C:
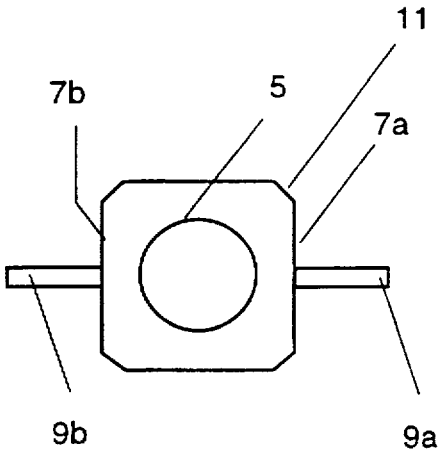
FIG. 2*c* shows the front view of the base of FIG. 2*a;*

FIGS. 2*a* through 2*c* show the top, side, and front views of base 3 of fluorescent lamp 1 of FIG. 1. Base 3 comprises an elongated, square-shaped central piece 6 and two circular-cylindrical-like extensions 4, 5. Extensions 4, 5 are each obliquely shaped at the two front sides of central piece 6, as illustrated in FIG. 1, in order to be able to take up the two ends of annular-shaped discharge tube 2. Two contact pins 8*a*, 9*a*, or 8*b*, 9*b*, project from the two side walls 7*a*, *b* of central piece 6 lying opposite one another. In this way, each two contacts 8*a*, 8*b* or 9*a*, 9*b* form a pair of contacts—a contact from each of two side walls 7*a*, 7*b* lying opposite one another. The first pair of contacts 8*a*, 8*b* is joined (not shown) with the two current leads of the first end of discharge vessel 2, and the other pair of contacts 9*a*, 9*b* is joined (not shown) with the current leads of the other end. Over and above this, the named side walls 7*a*, *b* each have two rectangular recesses 10*a*, 10*b* or 10*c*, 10*d* (recess 10*d* is concealed in the representation), whereby each pair of recesses 10*a*, 10*b* or 10*c*, 10*d* is arranged lying opposite one another in the region of the lengthwise edges. One recess 10*a*, 10*c* per side wall serves as the engagement opening for corresponding retaining springs of the mount belonging thereto. The other recess 10*b*, 10*d* serves for locking in the case of a correspondingly 180°-rotated base. The lengthwise edges of central piece 6 are provided with chamfers 11 in order to avoid tilting when inserted into the lamp mount.

Figure 3A:
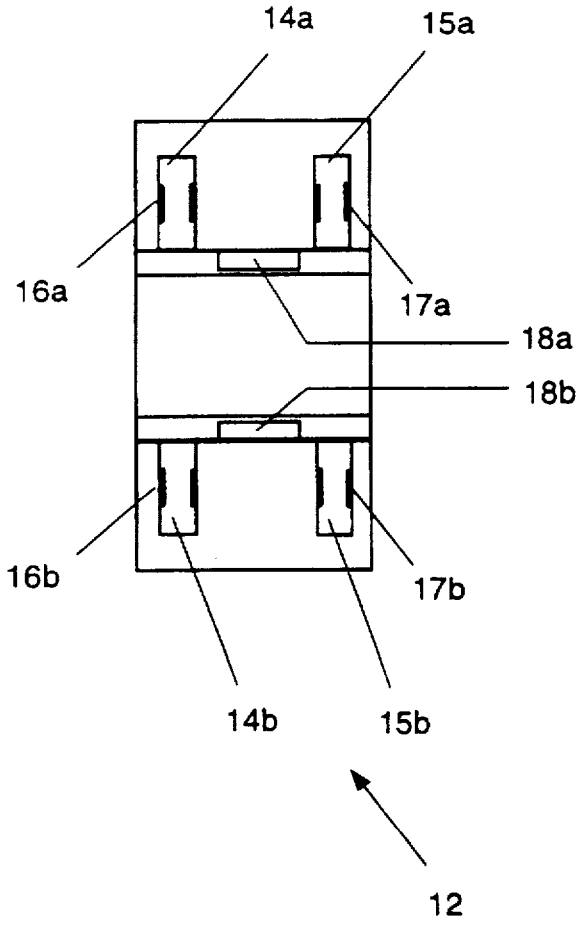
FIG. 3*a* shows the top view of a mount belonging to the base of FIG. 1.
Figure 3B:
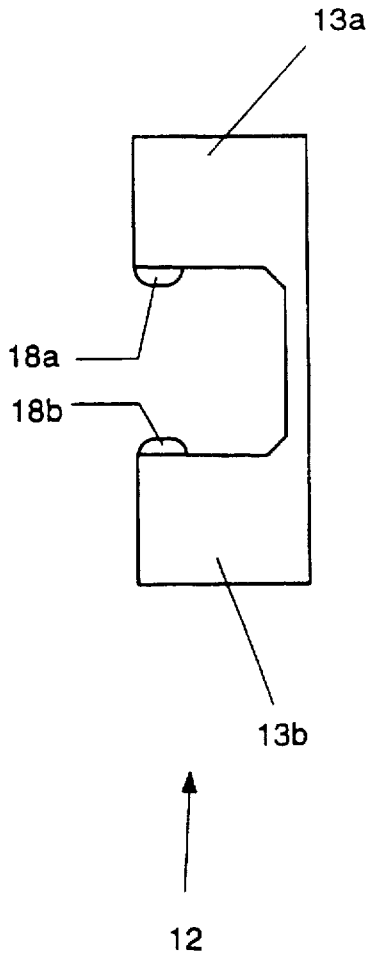
FIG. 3*b* shows the front view of the mount of FIG. 3*a*.

FIGS. 3*a* and 3*b* show the top view and the front view of a mount 12 belonging to the base of FIG. 1. The mount has a groove-shaped configuration with a rectangular base surface and a U-shaped front view. The two arms 13*a*, 13*b* of the mount each have two slot-type recesses 14*a*, 15*a* or 14*b*, 15*b* with spring contacts 16*a*, 17*a* or 16*b*, 17*b*. These serve for taking up and making contact with the corresponding pin contacts 8*a*, 9*a* or 8*b*, 9*b* of base 3. The two side walls of the groove-type opening between arms 13*a*, 13*b* are each provided with a nose-type retaining spring 18*a*, *b*. For making contact and locking the lamp, lamp base 3 is inserted (not shown) into the groove-type opening. Then retaining springs 18*a*, *b* of the mount engage in recesses 10*a*, 10*b* of base 3.

What is claimed is:

1. A low-pressure discharge lamp comprising:

a tube-shaped discharge vessel defining a lamp plane and having two ends facing each other, an electrode sealed at each of the ends of the discharge vessel, a base for receiving the two end of the discharge vessel, said base having base contacts arranged substantially in the lamp plane and comprising an elongated, square-shaped central piece with two side walls lying opposite one another and oriented essentially vertically to the lamp plane and two cylinder-shaped extensions disposed on two front sides of the central piece for taking up the two ends of the discharge vessel, two pins project as base contacts from each of the two side walls of the central piece.

2. The low-pressure discharge lamp according to claim 1 wherein the side walls of the base have recesses for locking with corresponding retaining springs of a lamp mount.

3. The low-pressure discharge lamp according to claim 1 wherein the discharge vessel has a circular cross section and an annular shape.

4. The low-pressure discharge lamp according to claim 3 wherein the cross section is less than 20 mm.

5. The low-pressure discharge lamp according to claim 3 wherein the cross section is approximately 16 mm.

6. The low-pressure discharge lamp according to claim 3 wherein the cylinder-shaped extensions have a circular-shaped cross section and are shaped obliquely corresponding to the curvature of the annular discharge vessel.

7. The low-pressure discharge lamp according to claim 1 wherein in the lamp is a fluorescent lamp.

8. A mount for a low-pressure discharge lamp with a base having pin contacts, said mount comprising a U-shaped housing having a groove for receiving a lamp base, said housing including two arms having opposing side walls, each of the arms having two slot-type recesses, and spring-type contacts arranged within said recesses for making contact with the corresponding pin contacts of the base.

9. The mount according to claim 8 wherein the opposing side walls of the arms are provided with nose-type retaining springs for engaging the base and thereby locking the lamp base in the mount.

* * * * *